US007712345B1

(12) United States Patent
Chen

(10) Patent No.: US 7,712,345 B1
(45) Date of Patent: May 11, 2010

(54) MAIN BEAM FABRICATION PROCEDURE AND SYSTEM FOR MAKING A MAIN BEAM FOR WAREHOUSE FRAMEWORK

(76) Inventor: Chun-Liang Chen, 2F., No. 20-1, Ting-Tien-Liao, Tamshui Town, Taipei Hsien (TW)

( * ) Notice: Subject to any disclaimer, the term of this patent is extended or adjusted under 35 U.S.C. 154(b) by 448 days.

(21) Appl. No.: 11/806,078

(22) Filed: May 29, 2007

(51) Int. Cl.
*B21B 15/00* (2006.01)
*B21F 11/00* (2006.01)
*B21B 19/00* (2006.01)

(52) U.S. Cl. ..... 72/177; 72/130; 72/161

(58) Field of Classification Search ..... 72/177, 72/129, 130, 161, 404, 405.01, 446–448
See application file for complete search history.

(56) References Cited

U.S. PATENT DOCUMENTS 4,274,332 A * 6/1981 Nakamura ..... 100/299
5,967,497 A * 10/1999 Denman et al. ..... 256/13.1
2002/0040525 A1* 4/2002 Himsl et al. ..... 29/897.2

* cited by examiner

*Primary Examiner*—Dana Ross
*Assistant Examiner*—Mohammad Yusuf
(74) *Attorney, Agent, or Firm*—Jackson IPG PLLC

(57) ABSTRACT

A main beam fabrication procedure and system for making main beams for warehouse framework through feeding, auto-forwarding and flattening, punching, roller shape-forming, cutting-off and finished product collection steps, in which the punching machine comprises an upper mold holder, four upper punching dies arranged in two longitudinal rows on the bottom side of the upper mold holder and adjustable to change the transverse pitch between the two longitudinal rows of upper punching dies, a bottom mold holder, and four bottom punching dies arranged in two longitudinal rows on the top side of the bottom mold holder and adjustable to change the transverse pitch between the two longitudinal rows of bottom punching dies.

2 Claims, 14 Drawing Sheets

MAIN BEAM FABRICATION PROCEDURE AND SYSTEM FOR MAKING A MAIN BEAM FOR WAREHOUSE FRAMEWORK

BACKGROUND AND SUMMARY OF THE INVENTION

The present invention relates to a main beam fabrication procedure and relates also to a main beam fabrication system, in which the punching machine has multiple pitch-adjustable punching dies for punching punch holes on the processing plate material subject to different specifications.

Conventionally, the fabrication of a main beam for warehouse framework includes the steps plate material feeding, auto-forwarding and flattening, punching, roller shape-forming, cutting-off, and finished product collection. A main beam fabrication system for this main beam fabrication procedure comprises a feeder rack adapted to feed a plate material to an auto-forwarding and flattening mechanism, an auto-forwarding and flattening mechanism adapted to flatten the plate material fed by the feeder rack and then to forward the flattened plate material to a punching machine, a punching machine operable to punch the flattened plate material delivered from the auto-forwarding and flattening mechanism to form four rows of punch holes 211,221,222,223,224,231 on the flattened plate material 2, a roller shape-forming machine adapted to ram the plate material punched by the punching machine into a shaped beam having a front wall 22, two curved sidewalls 21, 23, and a reinforcing groove 225 formed on the middle part of the front wall 22, and a cut-off machine adapted to cut off the shaped beam thus obtained from the roller shape-forming machine into multiple pieces of finished products subject to the desired length. According to this design, the pitch of the punching dies of the punching machine is not adjustable. When changing the specifications of the main beam, different punching dies must be used. Replacing the punching dies requires much time and labor. In conclusion, the aforesaid conventional punching machine has drawbacks as follows:

1. For making different specifications (sizes) of main beams, different punching dies should be used. The replacement and calibration of punching dies require much labor and time.

2. For making a same specification main beam from a different thickness of plate material, different punching dies should be used. The replacement and calibration of punching dies require much labor and time.

The present invention has been accomplished under the circumstances in view. It is one object of the present invention to provide a main beam fabrication procedure and system, which is adjustable to make different specifications of main beams without changing the punching dies. It is another object of the present invention to provide a main beam fabrication procedure and system, which saves much labor and processing time, thereby greatly reducing the main beam manufacturing cost.

To achieve these and other objects of the present invention, the main beam fabrication procedure is adapted to make main beams for warehouse framework through feeding, auto-forwarding and flattening, punching, roller shape-forming, cutting-off and finished product collection steps, wherein the punching machine comprises an upper mold holder, four upper punching dies arranged in two longitudinal rows on the bottom side of the upper mold holder and adjustable to change the transverse pitch between the two longitudinal rows of upper punching dies, a bottom mold holder, and four bottom punching dies arranged in two longitudinal rows on the top side of the bottom mold holder and adjustable to change the transverse pitch between the two longitudinal rows of bottom punching dies.

DETAILED DESCRIPTION OF THE INVENTION

Figure 1:
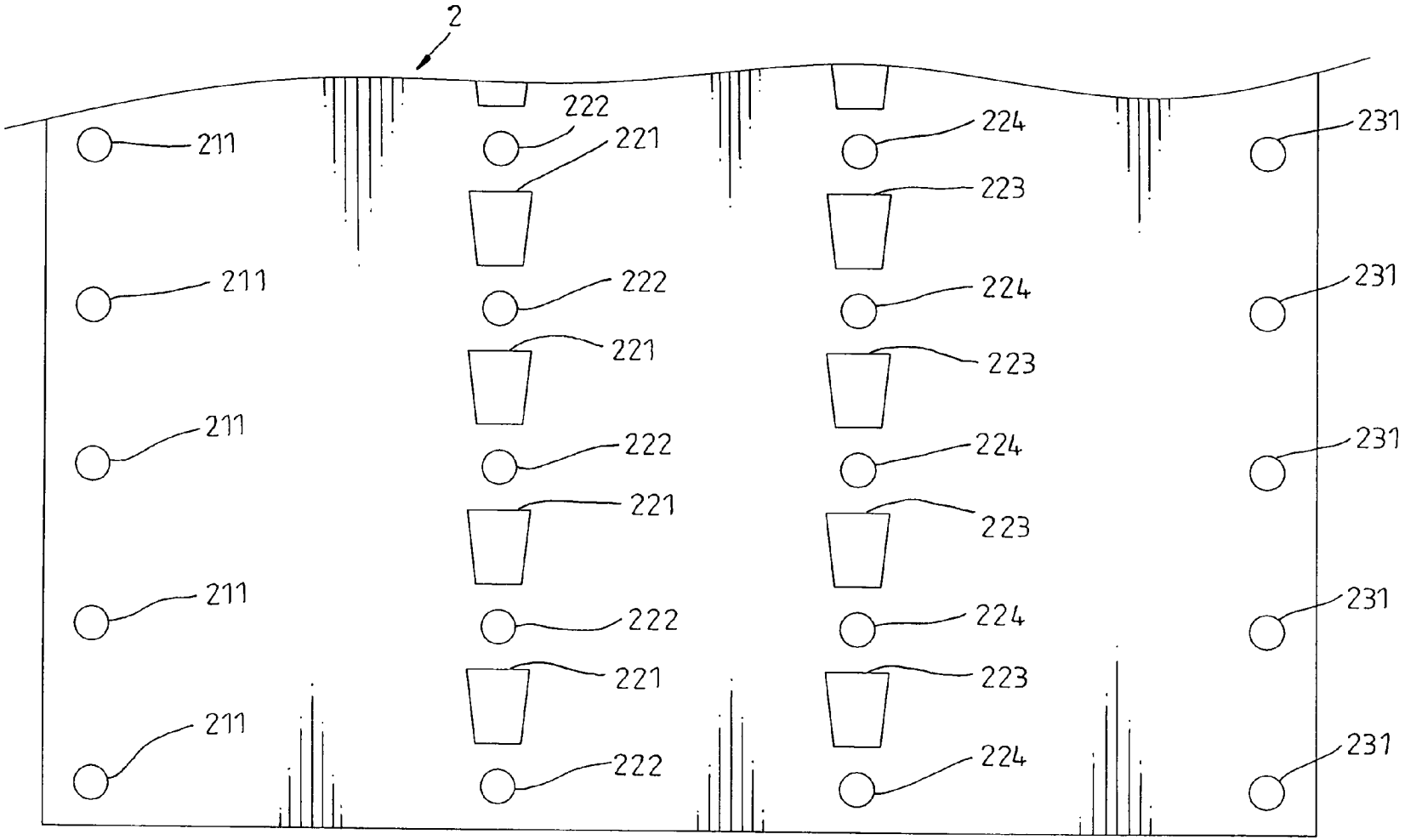
FIG. 1 is a schematic plain view of a part of a finished main beam made according to the present invention.
Figure 2:
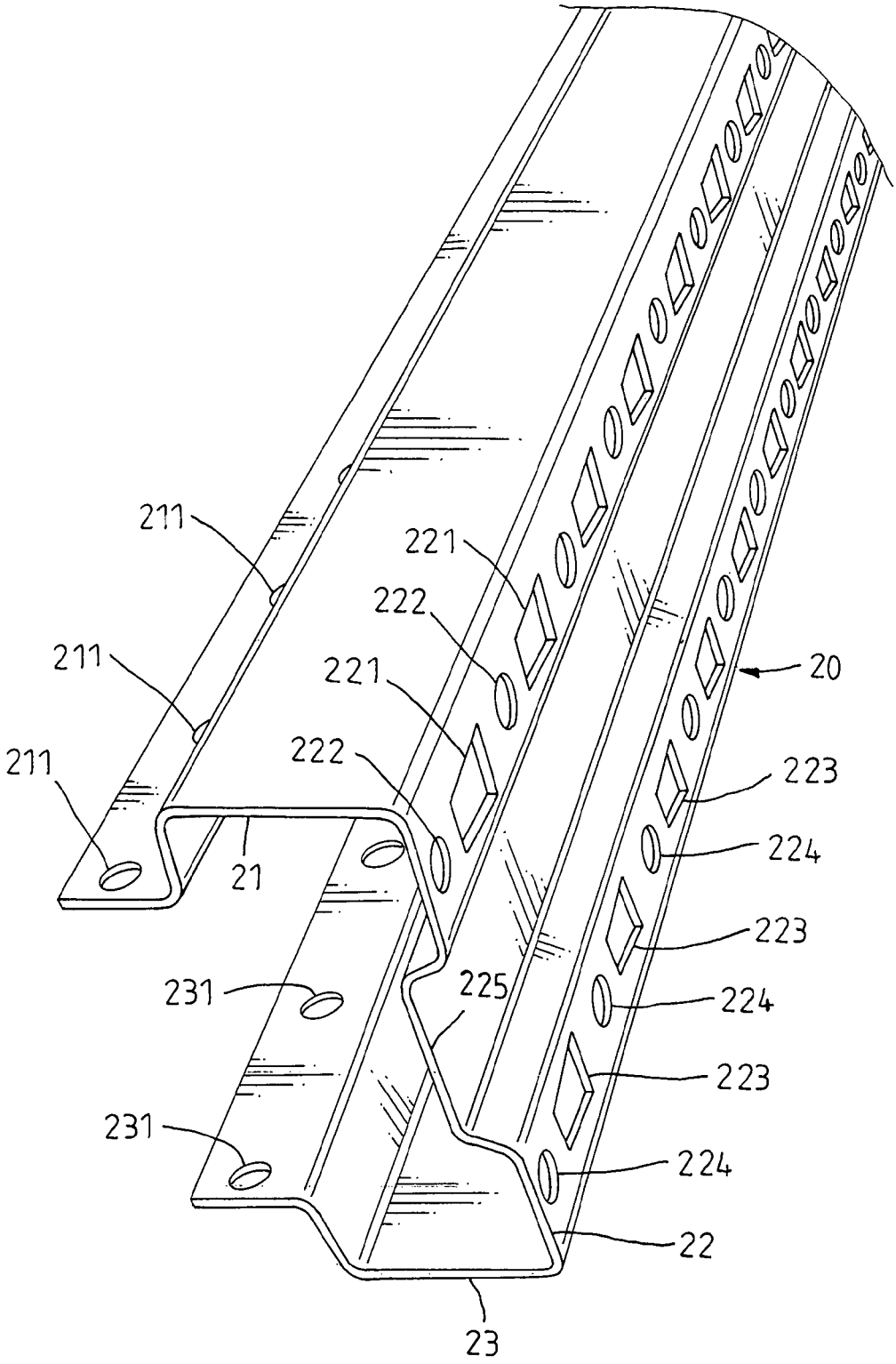
FIG. 2 is an elevational view of a finished main beam made according to the present invention.
Figure 3:
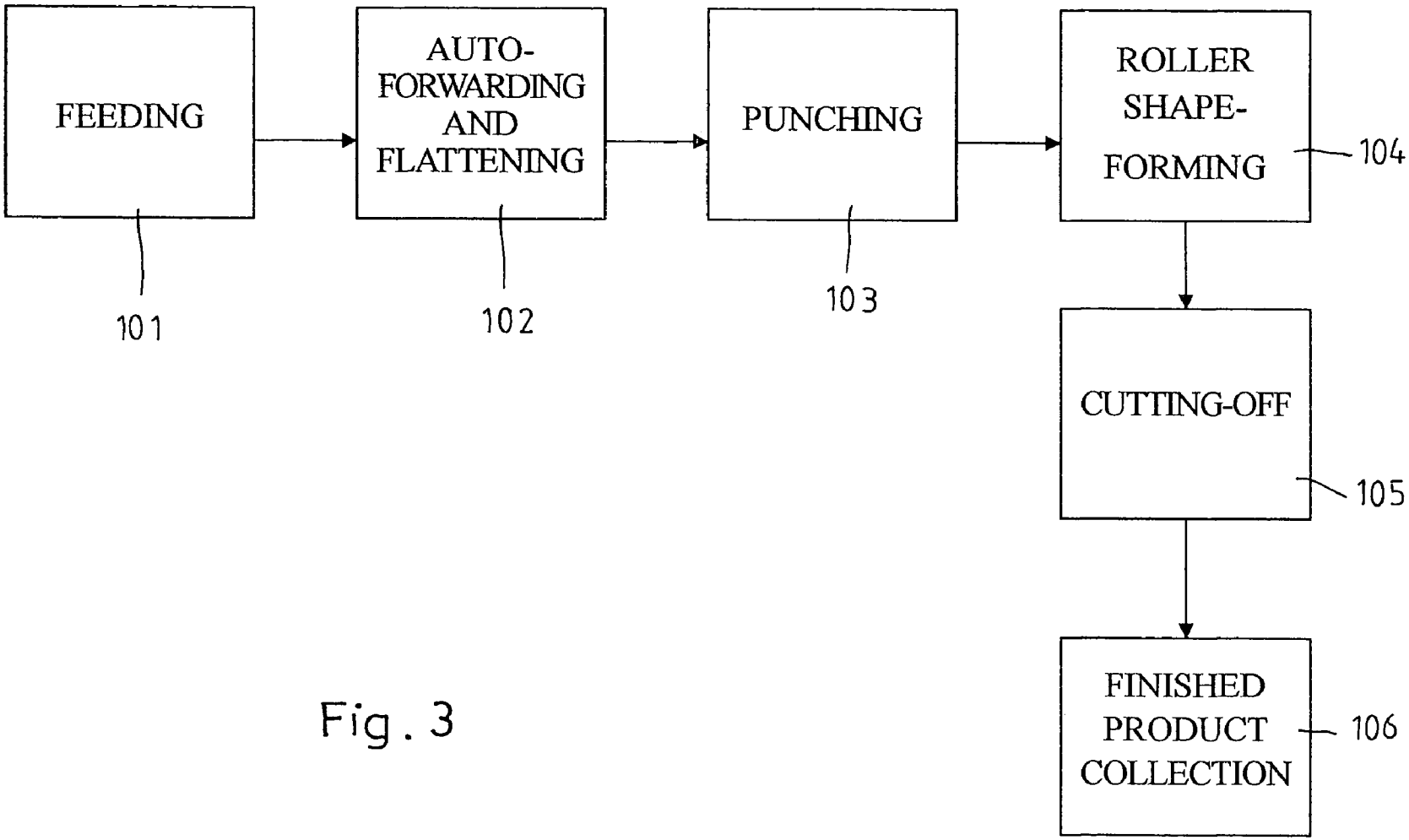
FIG. 3 is flow chart showing the fabrication of a main beam through a main beam fabrication system according to the present invention.
Figure 4:
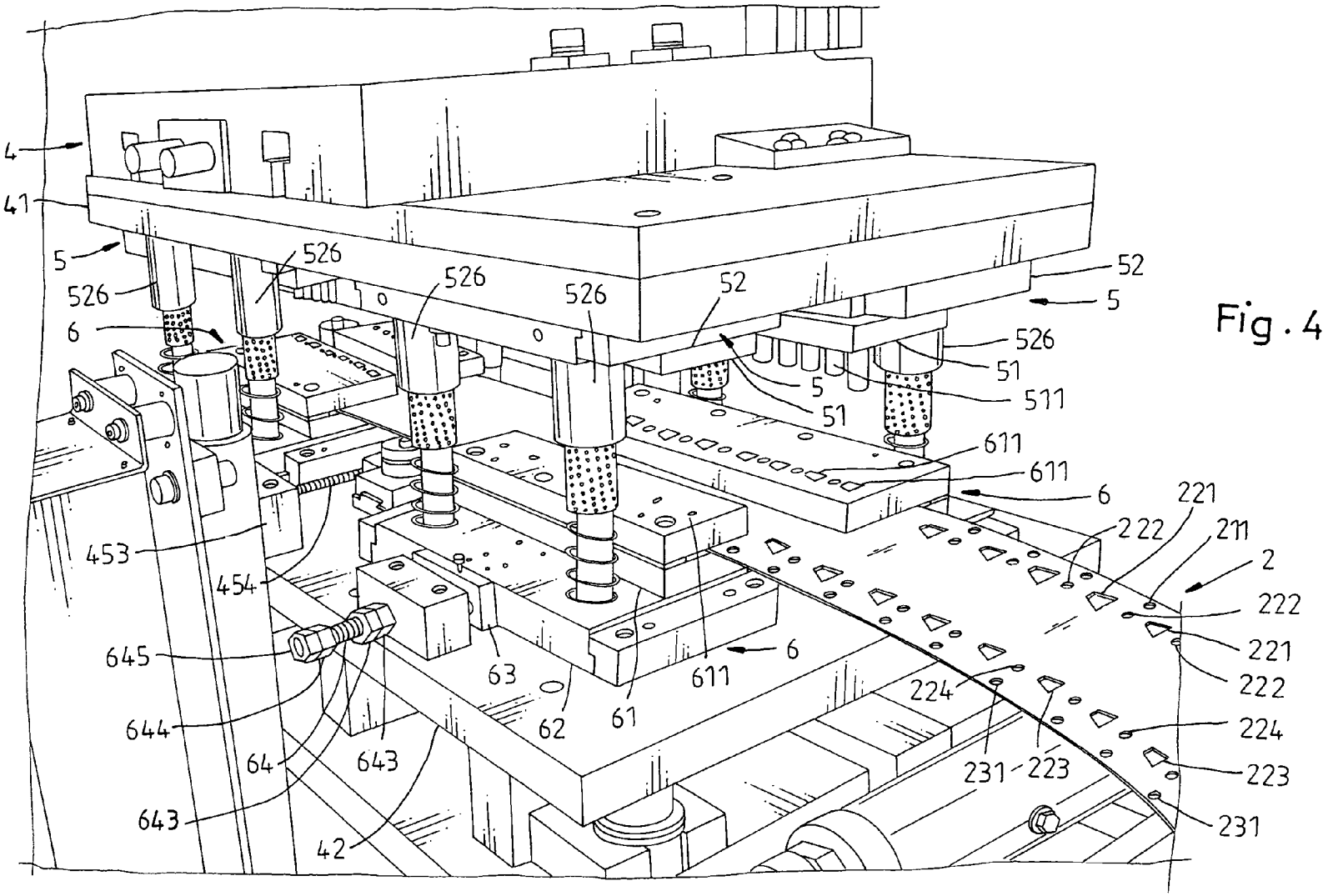
FIG. 4 is a perspective view of a part of the punching machine of a main beam fabrication system according to the present invention.

Referring to FIGS. 3-14, a main beam fabrication procedure for making a main beam for warehouse framework in accordance with the present invention comprises the steps of:

(101) Material feeding (see FIGS. 13 and 14), where a feeder rack 1 feeds a plate material 2 to an auto-forwarding and flattening mechanism 3;

(102) Auto-forwarding and flattening where the auto-forwarding and flattening mechanism 3 flattens the plate material 2 and then forwards the flattened plate material 2 to a punching machine 4;

(103) Punching where the punching machine 4 is operated to punch the plate material 2, forming four rows of punch holes 211, 221, 222, 223, 224, 231 on the plate material 2 (see FIGS. 1 and 4);

(104) Roller shape-forming where a roller shape-forming machine 7 is operated to ram the punched plate material 2 into a shaped beam 20 having a front wall 22 (see FIG. 2), two curved sidewalls 21, 23, and a reinforcing groove 225 formed on the middle and extending along the length of the front wall 22 with two rows of punch holes 221, 222, 223, 224 disposed at two opposite lateral sides of the reinforcing groove 225 and the other two rows of punch holes 211, 231 respectively disposed at the two curved sidewalls 21, 23;

(105) Cutting-off where a cut-off machine 8 is operated to cut off the shaped beam 20 thus obtained from the roller shape-forming machine 7 into multiple pieces of finished products subject to the desired length; and (106) Finished product collection where an outlet rack 80 is provided to collect the finished products for further packing and storage.

Figure 10:
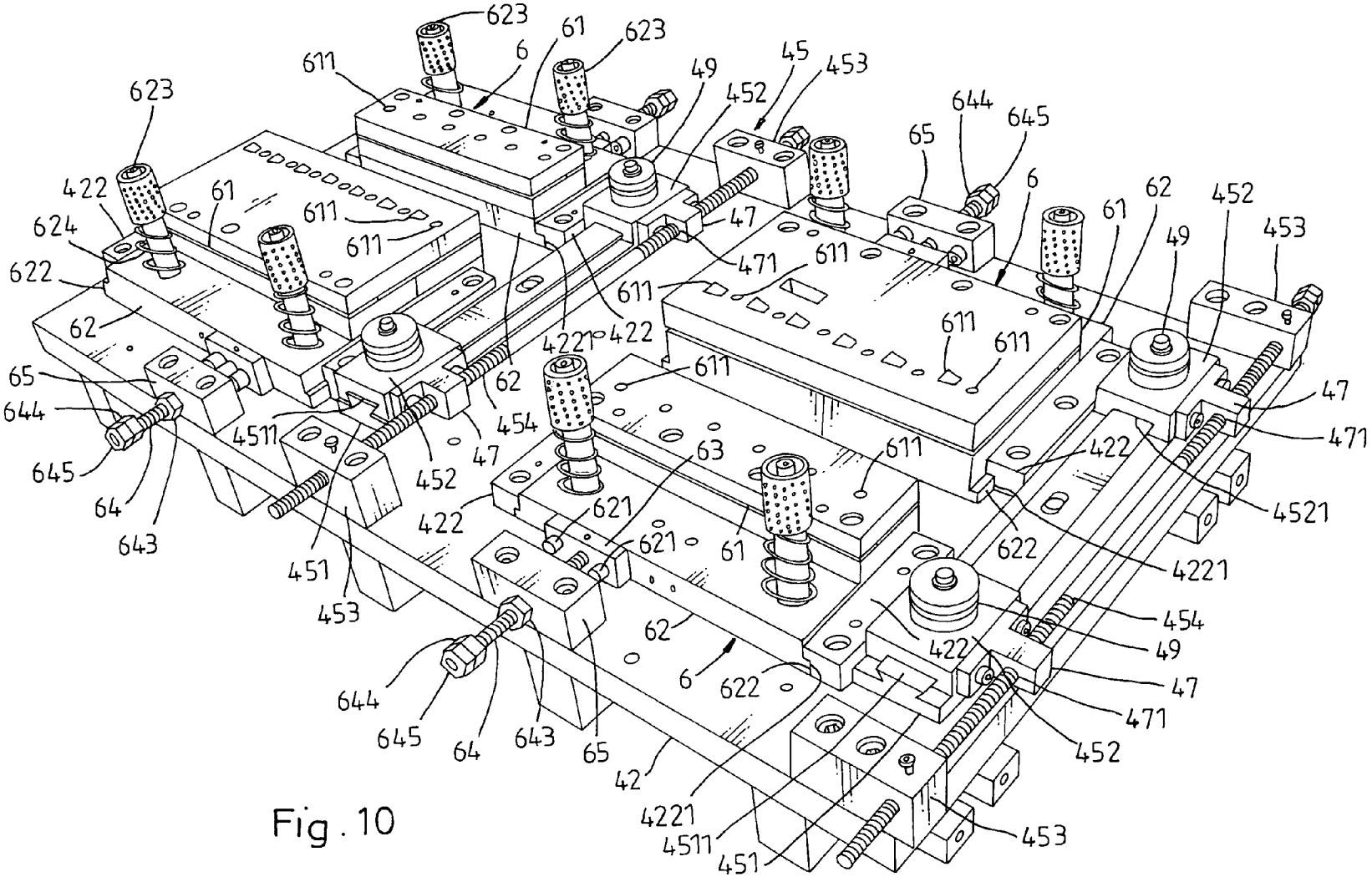
FIG. 10 is a perspective view of a part of the punching machine according to the present invention, showing the arrangement of the bottom punching dies on the bottom mold holder.
Figure 11:
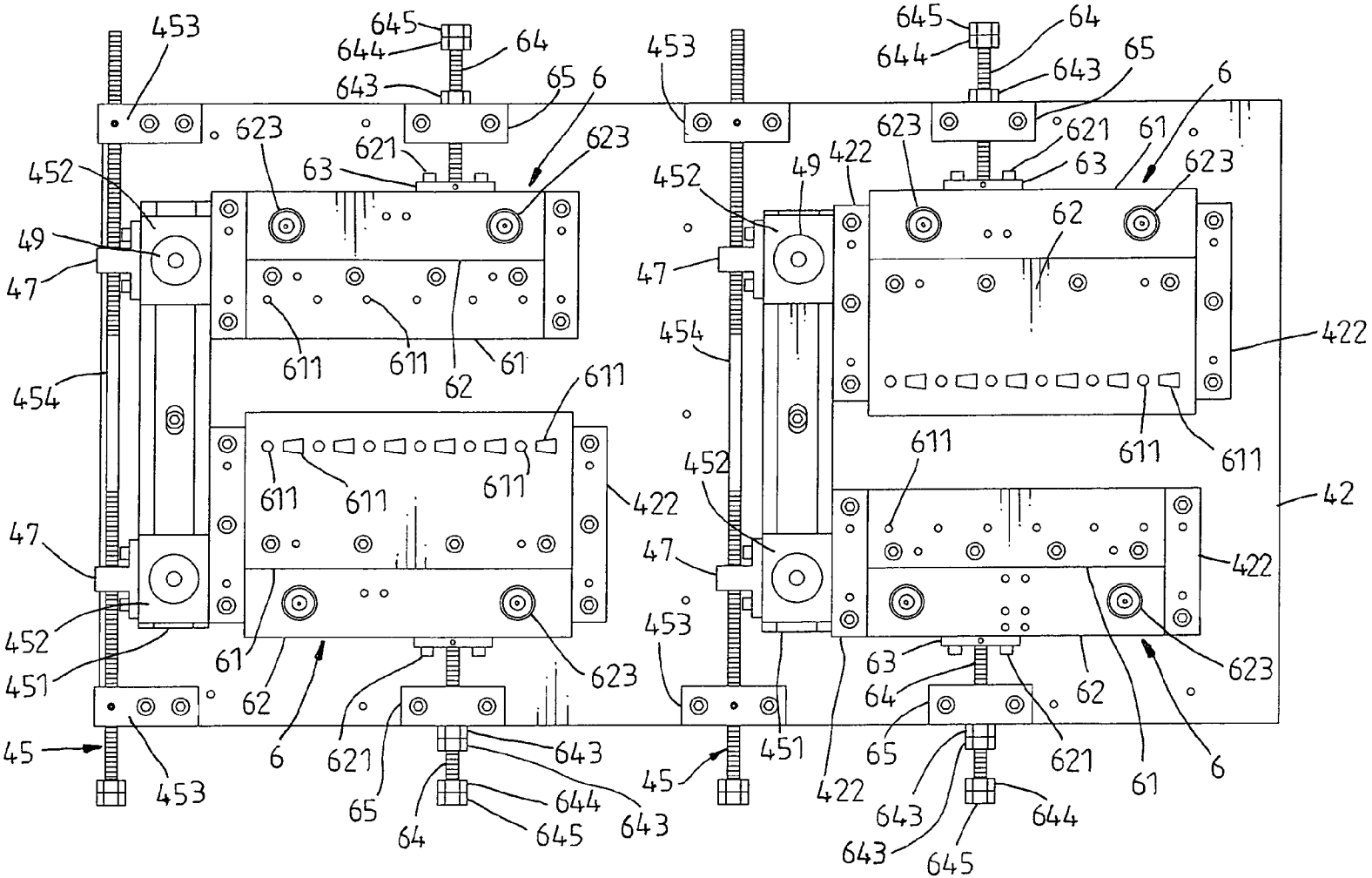
FIG. 11 is a top view of FIG. 10.

The aforesaid punching machine 4 comprises an upper mold holder 41, four upper punching dies 5 arranged in two longitudinal rows on the bottom side of the upper mold holder 41 and adjustable to change the transverse pitch (see FIG. 5), a bottom mold holder 42, and four bottom punching dies 6 arranged in two longitudinal rows on the top side of the bottom mold holder 42 and adjustable to change the transverse pitch (see FIGS. 10 and 11). By means of adjusting the pitch between the two rows of upper punching dies 5 and the pitch between the two rows of bottom punching dies 6, the punching machine 4 is capable of punching punch holes 211, 221, 222, 223, 224, 231 on any supplied plate material subject to the designed specifications. When changing the specifications, the operator needs not to change the punching dies but simply adjusting the pitch of the punching dies, saving much labor and time.

Figure 5:
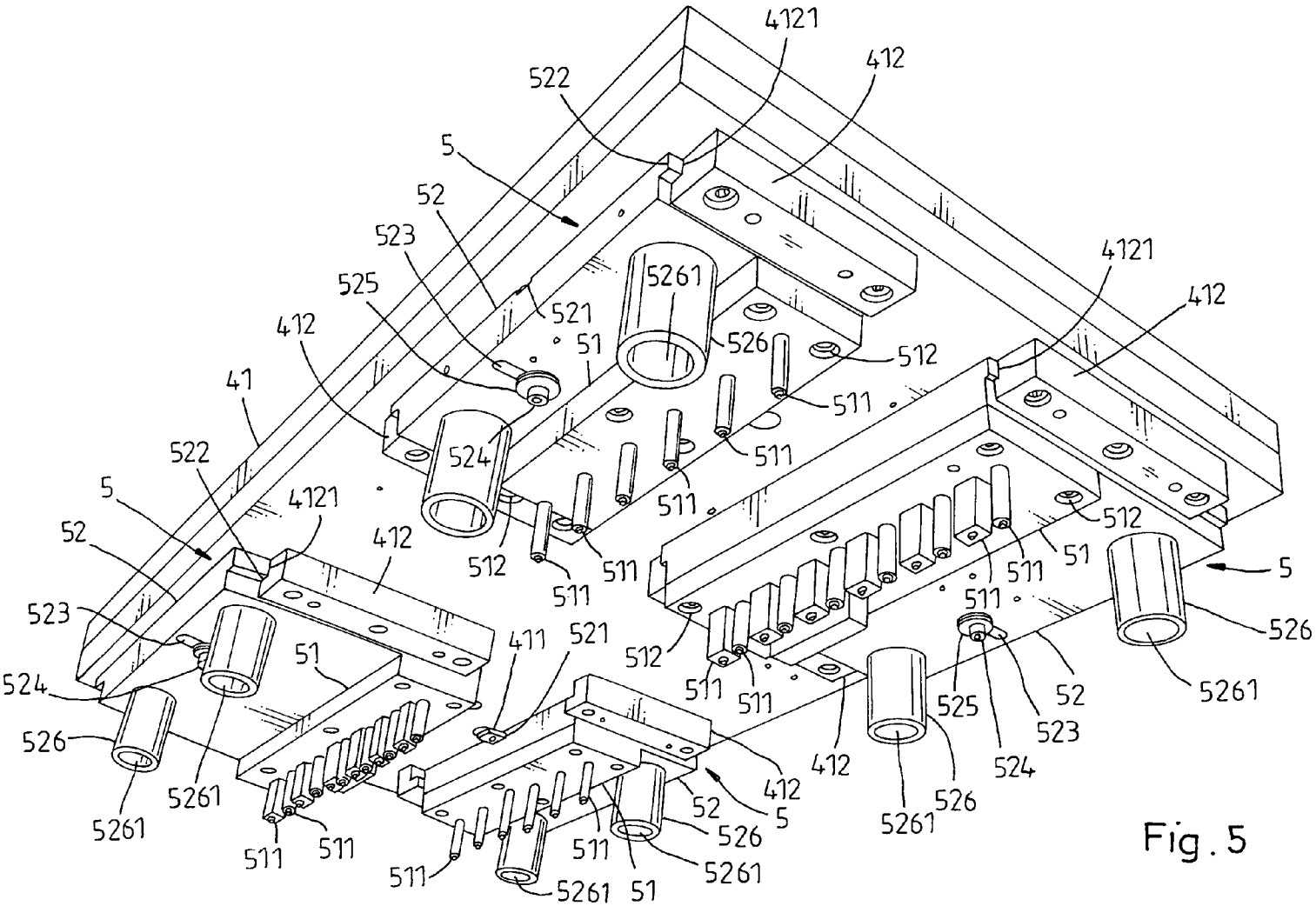
FIG. 5 is a perspective view of a part of the punching machine according to the present invention, showing the arrangement of the upper punching dies on the upper mold holder.
Figure 6:
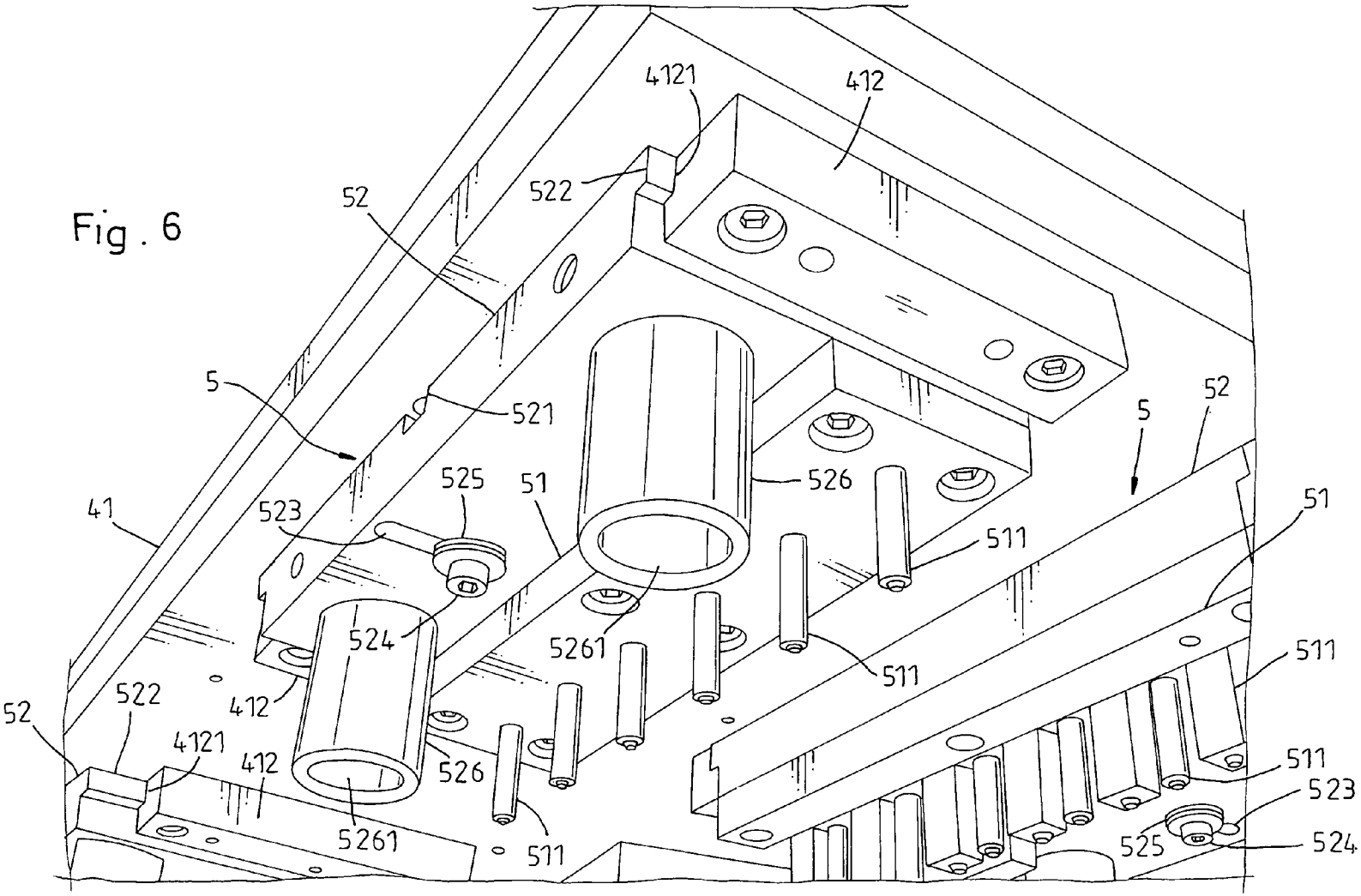
FIG. 6 is an enlarged view of a part of FIG. 5.
Figure 7:
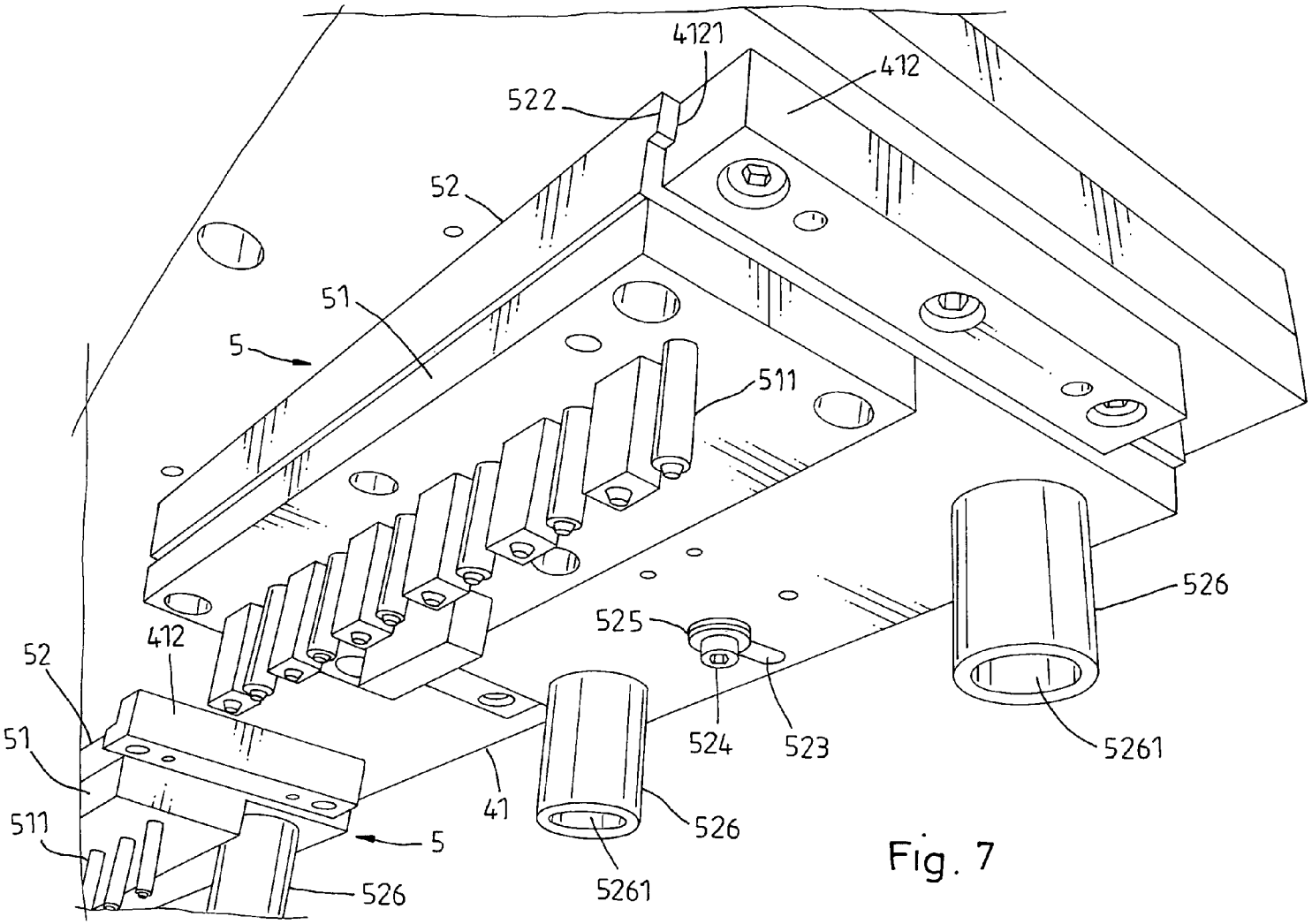
FIG. 7 is an enlarged view of a part of FIG. 5 when viewed from another angle.
Figure 8:
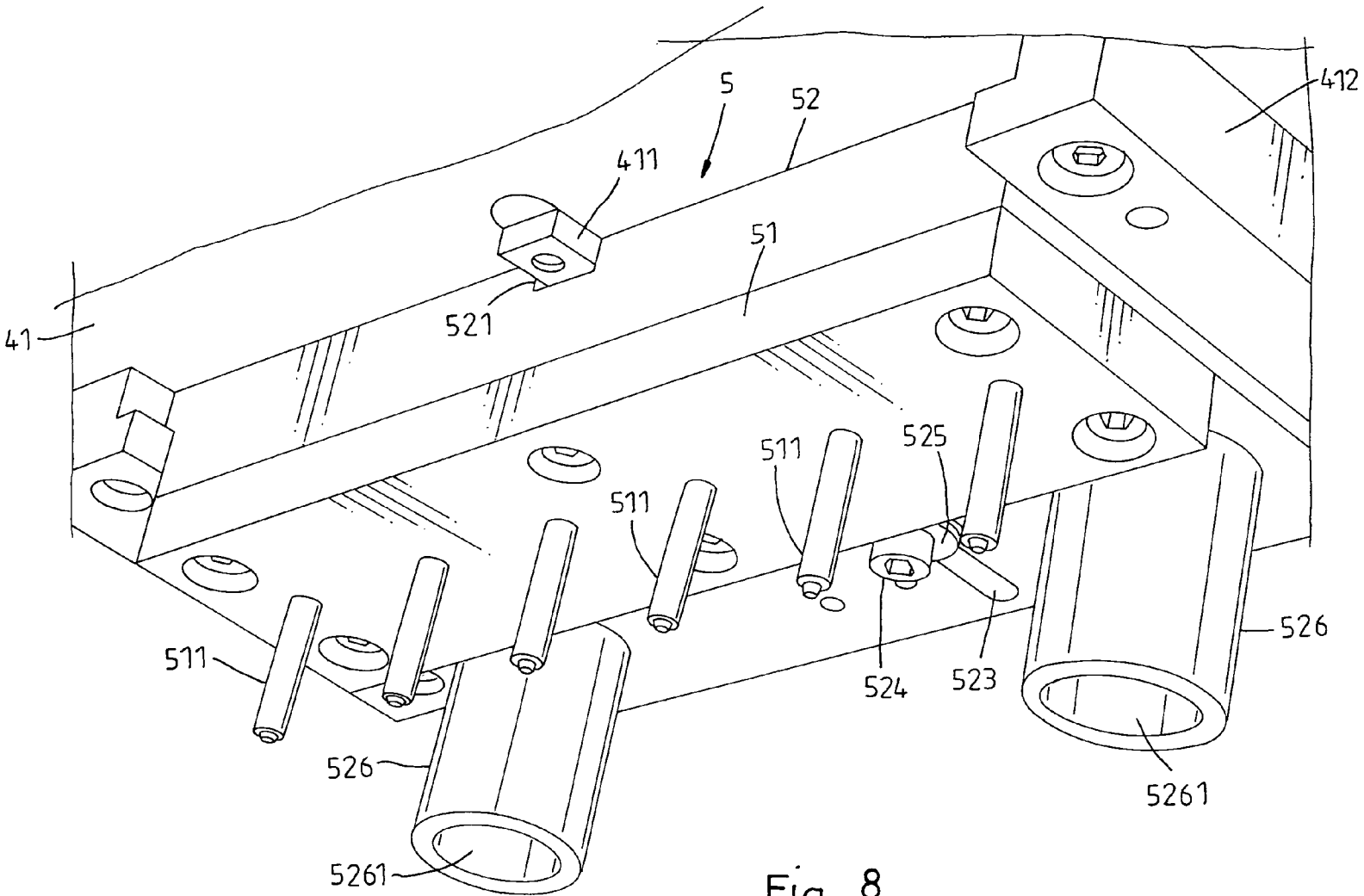
FIG. 8 is an enlarged view of a part of FIG. 5 when viewed from further another angle.
Figure 9:
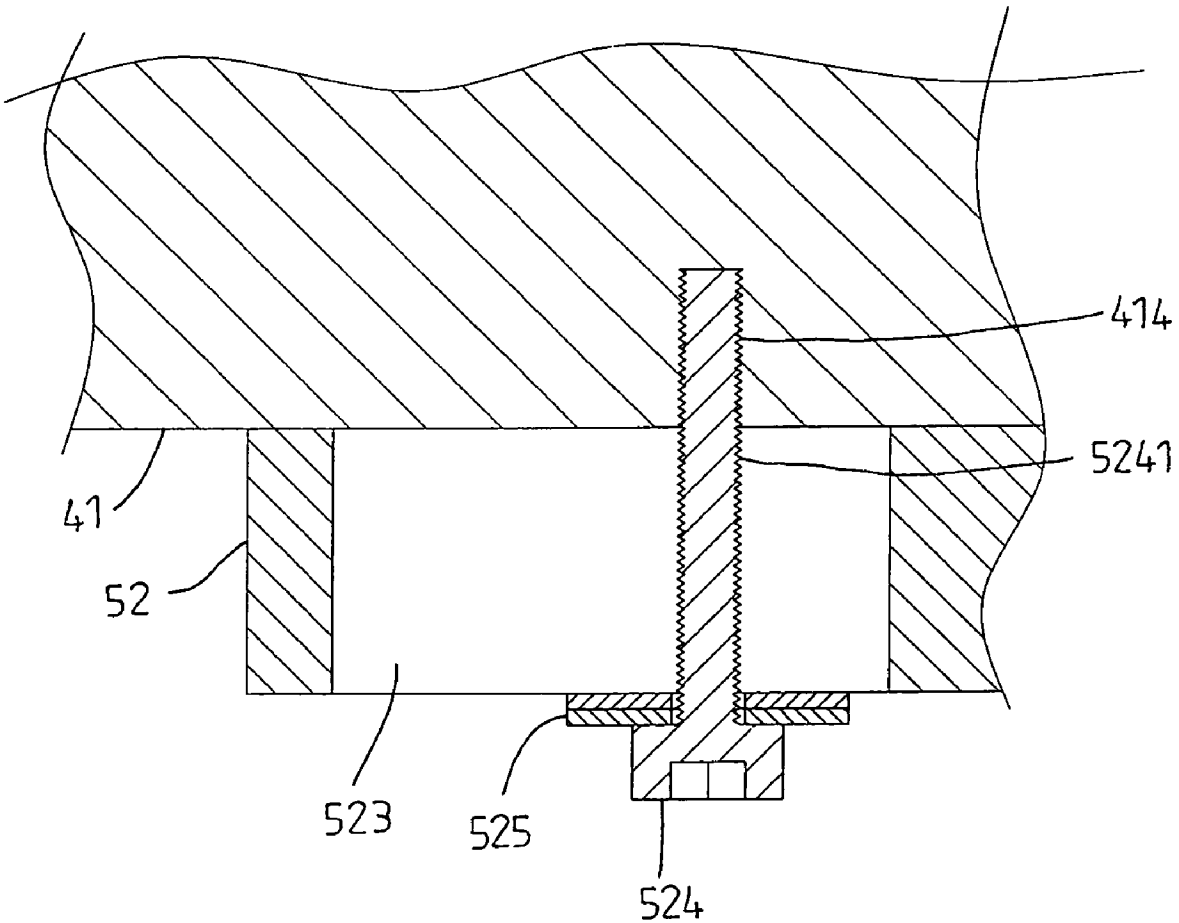
FIG. 9 is a sectional view of a part of the punching machine according to the present invention.

Further, each upper punching die 5 comprises a fixed upper die member 51 and an adjustable upper die member 52 (see FIG. 5). The fixed upper die member 51 comprises a row of punching rods 511, and is fastened to the adjustable upper die member 52 with fastening members 512. The adjustable upper die member 52 has a sliding groove 521 (see FIGS. 6 and 8) coupled to a respective sliding rail 411 at the upper mold holder 41 (see FIG. 8), two locating flanges 522 respectively protruded from the front and rear sides and respectively coupled to the locating grooves 4121 of the fixed locating blocks 412 at the upper mold holder 41, an elongated slot 523, a lock screw 524 mounted with a washer 525 on its threaded shank 5241 (see FIG. 9) and inserted through the elongated slot 523 and threaded into a screw hole 414 on the upper mold holder 41 to lock the adjustable upper die member 52 to the upper mold holder 41, and a plurality of vertically extending positioning columns 526. each position column 526 defines a sliding hole 5261. When loosening the lock screw 524, the adjustable upper die member 52 can be moved with the fixed upper die member 51 relative to the upper mold holder 41, adjusting the position of the respective upper punching die 5 on the upper mold holder 41.

Further, each bottom punching die 6 comprises a fixed bottom die member 61 and an adjustable bottom die member 62 (see FIGS. 10 and 11). The fixed bottom die member 61 comprises a row of die holes 611, and is fastened to the adjustable bottom die member 62. The adjustable bottom die member 62 has a connection member 63 fastened thereto with fastening members 621 (see FIGS. 12 and 13), and two locating flanges 622 respectively protruded from the front and rear sides (see FIG. 12) and respectively coupled to the locating grooves 4221 of the fixed locating blocks 422 at the bottom mold holder 42. The connection member 63 has a coupling groove 631. A control rod 64 is inserted through the connection member 63, having a block 641 disposed at one end and coupled to the coupling groove 631 of the connection member 63, a threaded shank 642 threaded through a screw hole 651 on a stop block 65 that is affixed to the bottom mold holder 42, a first locknut 643 threaded onto the threaded shank 642 and stopped at one side of the stop block 65, and two second locknuts 644 and 645 abutted against each other and threaded onto one end of the threaded shank 642 remote from the stop block 65 and the connection member 63. When loosened the first locknut 643, the control rod 64 is rotatable to move the associating adjustable bottom die member 62, adjusting the position of the associating adjustable bottom die member 62 relative to the bottom mold holder 42. The adjustable bottom die member 62 further comprises a plurality of vertically extending guide columns 623 respectively inserted into the sliding holes 5261 of the vertically extending positioning columns 526 of the adjustable bottom die member 52 of the associating upper punching die 5 (see FIG. 4), and a plurality of spring members 624 that support the vertically extending guide columns 623 respectively.

When adjusting the pitch of the upper punching dies 5 and the bottom punching dies 6, control the punching machine 4 to lower the upper mold holder 41 and the upper punching dies 5 and to force the sliding holes 5261 of the vertically extending positioning columns 526 of the adjustable bottom die members 52 of the upper punching dies 5 to the vertically extending guide columns 623 of the adjustable bottom die members 62 of the bottom punching dies 6, and then loosen the lock screws 524 from the adjustable upper die members 52 and the upper mold holder 41, and then loosen the first locknuts 643, and then rotate the control rods 64 to force the respective connection blocks 63 to move the associating adjustable bottom die members 62. During movement of the adjustable bottom die members 62, the vertically extending guide columns 623 force the vertically extending positioning columns 526 of the adjustable bottom die members 52 of the upper punching dies 5 to move with the adjustable bottom die members 62 synchronously. After adjustment, the lock screws 524 and the first locknuts 643 are fastened tight again.

Figure 12:
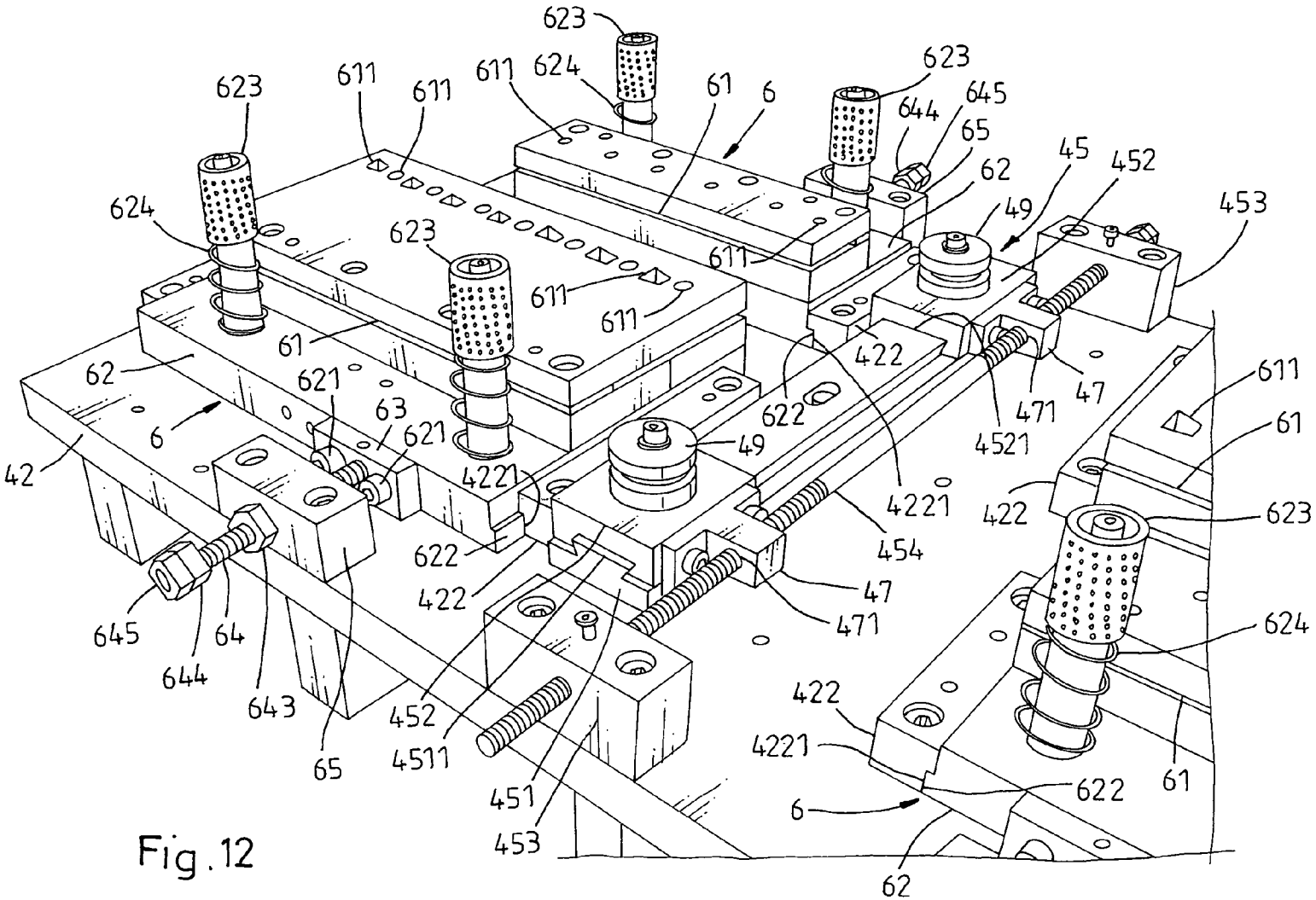
FIG. 12 is an enlarged view of a part of FIG. 10.
Figure 13:
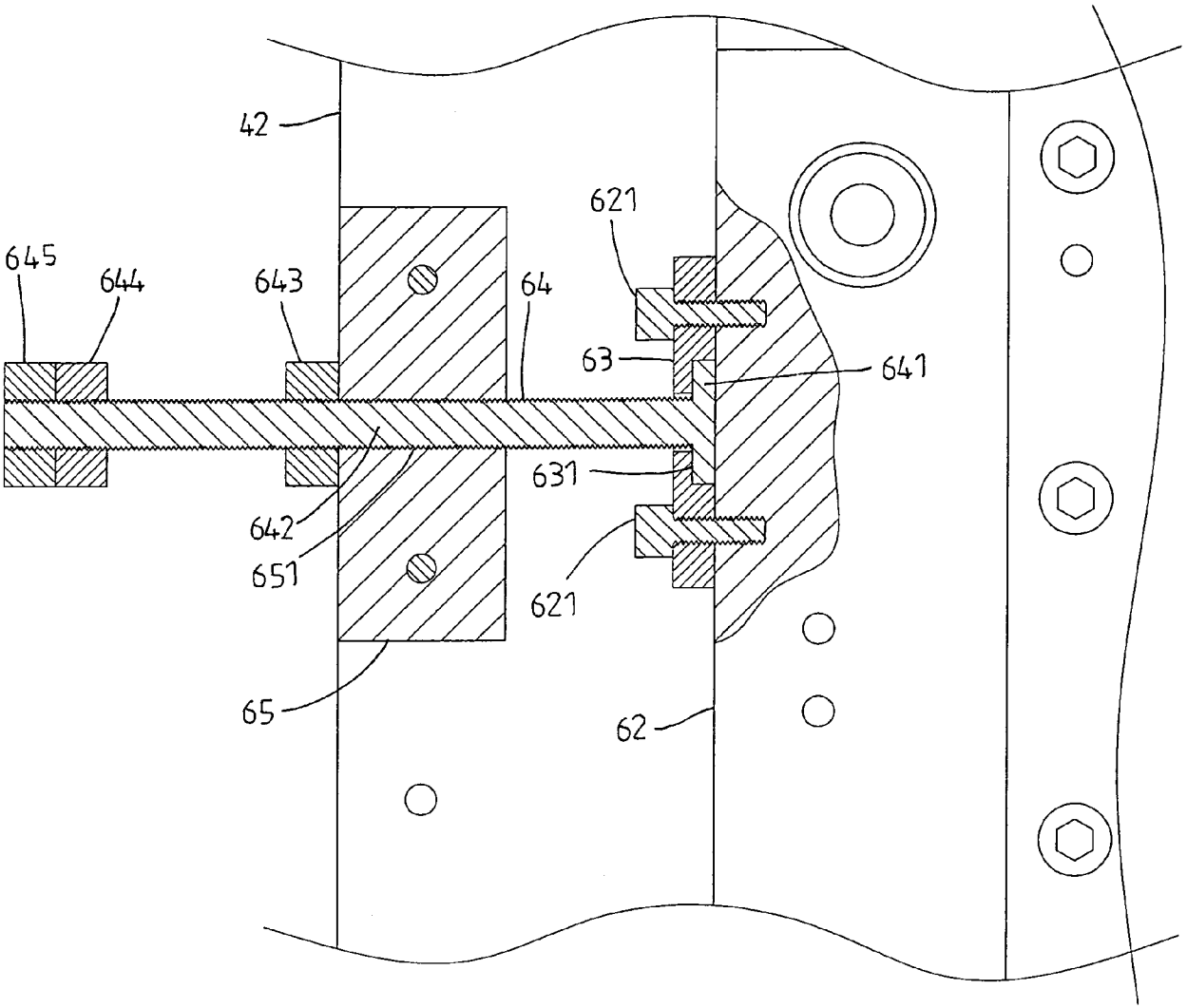
FIG. 13 is a sectional view in an enlarged scale of a part of FIG. 10.
Figure 14:
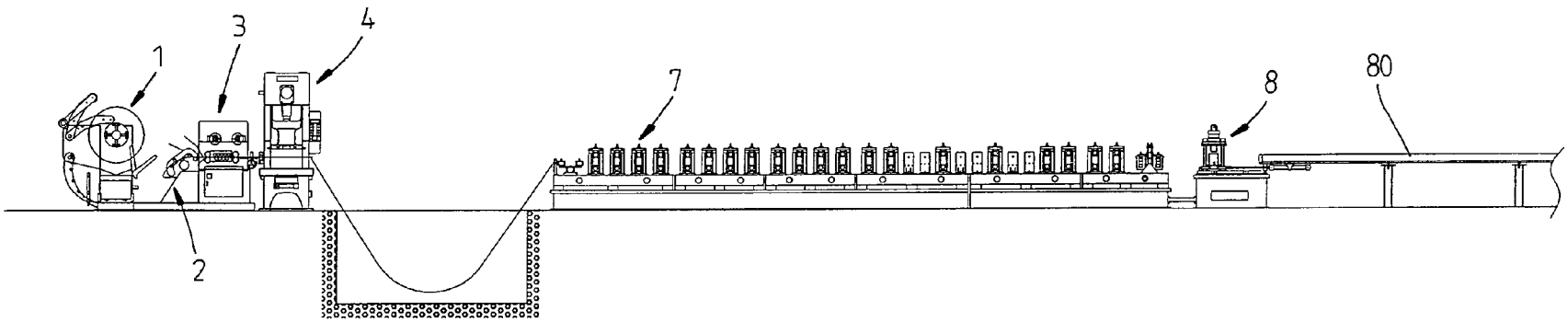
FIG. 14 is a schematic plain view of the main beam fabrication system according to the present invention.

Referring to FIGS. 10 and 12, the bottom mold holder 42 further comprises a plurality of pitch-adjustable guide roller sets 45 for guiding the delivery of the plate material 2. Each pitch-adjustable guide roller set 45 comprises a mounting base 451, two sliding blocks 452, two screw rod holders 453, a double-thread screw 454, two actuating blocks 47, and two guide rollers 49. The two screw rod holders 453 are affixed to the top side of the bottom mold holder 42. The mounting base 451 is affixed to the top side of the bottom mold holder 42 between the two screw rod holders 453, having a sliding rail 4511 at the top. The two sliding blocks 452 each have a coupling groove respectively coupled to the sliding rail 4511. The guide rollers 49 are respectively pivoted to the sliding blocks 452. The two actuating blocks 47 are respectively affixed to the sliding blocks 452 at one side, each having a threaded through hole 471. The double-thread screw 454 is threaded through the threaded through holes 471 of the actuating blocks 47 and fastened with the two distal ends thereof to the screw rod holders 453 respectively. When rotating the double-thread screw 454, the two sliding blocks 452 are moved along the sliding rail 4511 relative to each other, thereby adjusting the pitch between the two guide rollers 49.

As stated above, the invention provides a main beam fabrication system, which has the following advantages:

1. When processing a different specification of main beam, the operator can adjust the pitch of the upper punching dies 5 and the bottom punching dies 6 without changing the dies.

2. The design of the present invention saves much labor and time in die mounting, dismounting, and calibration. In consequence, the main beam manufacturing cost is relatively lowered.

3. The invention eliminates the necessity of preparing extra spare punching dies, saving much inventory space.

What is claimed is:

1. A main beam fabrication system comprising:

a feeder rack adapted to feed a plate material to an auto-forwarding and flattening mechanism;

an auto-forwarding and flattening mechanism adapted to flatten the plate material fed by said feeder rack and then to forward the flattened plate material to a punching machine;

a punching machine operable to punch the flattened plate material delivered from said auto-forwarding and flattening mechanism to form four rows of punch holes on the flattened plate material;

a roller shape-forming machine adapted to ram the plate material punched by said punching machine into a shaped beam having a front wall, two curved sidewalls, and a reinforcing groove formed on a middle part of said front wall and extending along the length of said front wall with two rows of said four rows of punch holes disposed at two opposite lateral sides of said reinforcing groove and the other two rows of said four rows of punch holes respectively disposed at said two curved sidewalls; and a cut-off machine adapted to cut off the shaped beam thus obtained from said roller shape-forming machine into multiple pieces of finished products subject to the desired length;

wherein said punching machine comprises an upper mold holder, four upper punching dies arranged in two longitudinal rows on a bottom side of said upper mold holder and adjustable to change the transverse pitch between the two longitudinal rows of said four upper punching dies, a bottom mold holder, and four bottom punching dies arranged in two longitudinal rows on a top side of said bottom mold holder and adjustable to change the transverse pitch between the two longitudinal rows of bottom punching dies;

said upper punching dies each comprise a fixed upper die member and an adjustable upper die member, said fixed upper die member comprising a row of punching rods and being fastened to said adjustable upper die member with fastening members, said adjustable upper die member having a sliding groove coupled to a respective sliding rail at said upper mold holder, two locating flanges respectively protruded from front and rear sides thereof and respectively coupled to locating grooves of fixed locating blocks at said upper mold holder, an elongated slot, a lock screw mounted with a washer on a threaded shank thereof and inserted through said elongated slot and threaded into a screw hole on said upper mold holder to lock said adjustable upper die member to said upper mold holder, and a plurality of vertically extending positioning columns each defining a sliding hole;

said bottom punching dies each comprise a fixed bottom die member and an adjustable bottom die member, said fixed bottom die member comprising a row of die holes and being fastened to said adjustable bottom die member, said adjustable bottom die member having a connection member fastened thereto with fastening members, and two locating flanges respectively protruded from front and rear sides thereof and respectively coupled to respective locating grooves of respective fixed locating blocks at said bottom mold holder, said connection member having a coupling groove, a control rod inserted through said connection member, said control rod having a block disposed at one end thereof and coupled to the coupling groove of said connection member, a threaded shank threaded through a screw hole on a stop block that is affixed to said bottom mold holder, a first locknut threaded onto said threaded shank and stopped at one side of said stop block, and two second locknuts abutted against each other and threaded onto one end of said threaded shank remote from said stop block and said connection member.

2. The main beam fabrication system as claimed in claim 1, wherein said bottom mold holder further comprises a plurality of pitch-adjustable guide roller sets for guiding the delivery of the plate material under processing, said pitch-adjustable guide roller sets each comprising a mounting base, two sliding blocks, two screw rod holders, a double-thread screw, two actuating blocks, and two guide rollers, said two screw rod holders being affixed to said bottom mold holder, said mounting base being affixed to said bottom mold holder between said two screw rod holders and having a sliding rail at a top side thereof, said two sliding blocks each having a coupling groove respectively coupled to said sliding rail, said guide rollers being respectively pivoted to said sliding blocks, said two actuating blocks being respectively affixed to said sliding blocks at one side, said two actuating blocks each having a threaded through hole, said double-thread screw being threaded through the threaded through holes of said actuating blocks and fastened with two distal ends thereof to said screw rod holders respectively.

* * * * *